United States Patent [19]

Reich et al.

[11] Patent Number: 4,908,602

[45] Date of Patent: Mar. 13, 1990

[54] APPARATUS AND METHOD OF TESTING A PORTABLE HELD BUTTON FOR EMERGENCY RESPONSE SYSTEM

[75] Inventors: Richard M. Reich, Westwood; Phillip H. Devlin, Brookline, both of Mass.

[73] Assignee: Lifeline Systems, Inc., Watertown, Mass.

[21] Appl. No.: 331,460

[22] Filed: Mar. 31, 1989

[51] Int. Cl.[4] ..... G08B 29/00

[52] U.S. Cl. ..... 340/514; 340/506; 340/539; 340/531

[58] Field of Search ..... 340/514, 515, 506, 531, 340/532, 534, 539, 825.46, 825.69, 825.72

[56] References Cited

U.S. PATENT DOCUMENTS

| | | | |
|---|---|---|---|
| 3,668,526 | 6/1972 | Raskin | 340/539 |
| 3,833,895 | 9/1974 | Fecteau | 340/539 |
| 3,969,709 | 7/1976 | Isaacs et al. | 340/539 |
| 4,338,493 | 7/1982 | Stenhuis et al. . | |
| 4,656,319 | 4/1987 | Bially | 379/29 |
| 4,760,593 | 7/1988 | Shapiro et al. | 379/38 |

*Primary Examiner*—Donnie L. Crosland
*Attorney, Agent, or Firm*—Weingarten, Schurgin, Gagnebin & Hayes

[57] ABSTRACT

An apparatus and method to test the internal functioning and operational limitations of a personal emergency response (PER) system. In the normal mode of operation of a PER system, a coded or uncoded activating signal transmitted by a portable help button activates elements of a subscriber unit in a subscriber station remote from a central station to transmit an alarm message to the central station. A subscriber unit according to the present invention includes a momentary action button, which when activated, places the subscriber unit in a test mode. While in the test mode, the subscriber unit will not transmit alarm messages to the external central station in response to a valid activating signal. The subscriber unit will, however, activate an annunciator to inform the subscriber of proper functioning of the portable help button in combination with certain elements of the subscriber unit. Operation in the test mode may be used to verify that a coded activating signal transmitted by the portable help button is synchronized with the corresponding subscriber unit. The subscriber may also use the test mode to ascertain operating limitations such as range limitations and/or transmission dead spots by selectively operating the portable help button at various locations within the vicinity of the subscriber station.

14 Claims, 2 Drawing Sheets

APPARATUS AND METHOD OF TESTING A PORTABLE HELD BUTTON FOR EMERGENCY RESPONSE SYSTEM

RELATED APPLICATION

This application is related to U.S. patent applications entitled ADDRESS CODE MODIFICATION IN A TRANSMITTER RECEIVER PAIR, Ser. No. 07/203,251, filed June 6, 1988, and APPARATUS AND METHOD FOR REPORTING VERIFICATION TESTING OF A PERSONAL EMERGENCY RESPONSE SYSTEM, Ser. No. 07/290,470, filed Dec. 7, 1988.

FIELD OF THE INVENTION

This invention relates generally to personal emergency response systems, and more particularly to an apparatus and method of testing the internal operation of a personal emergency response system.

BACKGROUND OF THE INVENTION

Personal emergency response (PER) systems are known in the art. Representative examples of such systems are disclosed in U.S. Pat. Nos. 4,656,319, 4,524,243, 4,064,368 and 3,989,900, owned by the assignee of the present application. A PER system includes a central station and one or more remote subscriber stations such as a residence or business interconnected therewith.

The central station may be any facility such as a hospital, a police station, a fire station, a phone answering service or a burglary alarm monitoring service which responds to alarm messages generated by remote subscriber stations to provide assistance thereto. The central station is interconnected with the remote subscriber stations via communications links.

Various communication links may be utilized to interconnect the central station with remote subscriber stations including telephone communication lines, cable television transmission lines, radio frequency transmissions or dedicated land lines. Typically, telephone communication lines are utilized due to the prevalence of in-place telephone networks and the minimal expense necessary to interface a personal emergency response system with a telephone network.

Each remote subscriber station includes a subscriber unit interfaced with the communications link. Upon activation of the subscriber unit in response to a predetermined event, an alarm message is transmitted via the communications link to the central station.

Various means may be utilized to activate the subscriber unit to transmit an alarm message. The subscriber unit may include a timing/logic circuit which is operative to automatically activate the unit upon expiration of a predetermined period of time. A subscriber unit of this type will also include a subscriber-activated reset means which reinitializes the timing circuit. The reset means may be interfaced with any device frequently used by the subscriber such as electrical switches, television sets, radios, refrigerators, stoves or telephones wherein the use of any such device causes the timing circuit to be reset to zero.

The subscriber unit may also be activated by means of a portable help button carried by the subscriber. A portable help button is particularly useful to elderly or infirm subscribers who may be prone to acute emergencies requiring an immediate response. The portable help button also has utility for notifying the central station of an event such as a fire or an intruder in the remote subscriber station. When immediate assistance is required by the subscriber, the portable help button is manually operated to activate the PER system.

The portable help button is typically a wireless unit which transmits a coded or uncoded signal to activate the subscriber unit located within the remote subscriber station. Most commonly the portable help button is a radio transmitter, although infrared and ultrasonic transmitters may also be used.

Since the portable help button is a critical link of the PER system, it is of paramount importance that the portable help button be periodically tested to ensure proper operation thereof in combination with elements of the subscriber unit and/or to inform the subscriber of any limiting conditions. Since the portable help button is self powered, one possible deficiency is the depletion of the power source to such a level that the portable help button is no longer capable of generating a signal which will activate the PER system. Other possible deficiencies of which the subscriber should immediately be made aware of include any help button malfunction or damage which precludes generation of the activating signal.

Furthermore, for PER systems which utilize a coded activating signal, it is desirable to ensure that the portable help button is transmitting a properly coded activating signal and to ensure that the subscriber unit is synchronized to receive and recognize the coded activating signal broadcast by the corresponding portable help button.

In addition to deficiencies affecting the functioning of the portable help button and/or the subscriber unit, it will be appreciated that a wireless portable help button may also be subject to range limitations and/or transmission dead spots, that is, locations in the vicinity of the subscriber station from which an activating signal cannot be received by the subscriber unit.

It is therefore of paramount importance that the subscriber be made aware of any functional, range and/or location deficiencies affecting the portable help button. While it is desirous to periodically test the operation of the portable help button, it will be appreciated that such testing should not cause the PER system to generate and transmit an alarm message to the central station. Transmission of an alarm message to the external central station during testing unnecessarily ties up the resources of the central station which may result in delayed responses to actual emergency conditions in other remote subscriber stations as well as provoking an unnecessary response to the particular remote subscriber station.

SUMMARY OF THE INVENTION

To provide a means of testing the internal operation and/or defining the limitations of a portable help button in combination with the subscriber unit without degrading the operational capabilities of the PER system, the present invention is directed to a personal emergency response system which includes selection means for placing the personal emergency response system in a test mode such that operation of the portable help button does not activate the corresponding subscriber unit to transmit an alarm message to the central station.

The PER system according to the present invention includes a momentary action button incorporated in the subscriber unit to selectively place the subscriber unit in a test mode. While in the test mode, the subscriber unit is operative to receive activating signals transmitted by the portable help button. The signals received by the subscriber unit, however, will not cause the subscriber unit to transmit an alarm message to the central station.

Instead, activating signals transmitted by the portable help button with the subscriber unit in the test mode activate an annunciator associated with the subscriber unit. A perceptible signal generated by the annunciator provides feedback to the subscriber that corresponding signals transmitted by the portable help button were received and recognized by the subscriber unit and would have activated the subscriber unit if operating in the normal mode.

This apprises the subscriber as to the proper functioning of the portable help button in combination with elements of the subscriber unit. Data is also provided to the subscriber as to range limitations and transmission dead spots of the portable help button vis-a-vis the layout of the remote subscriber station.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
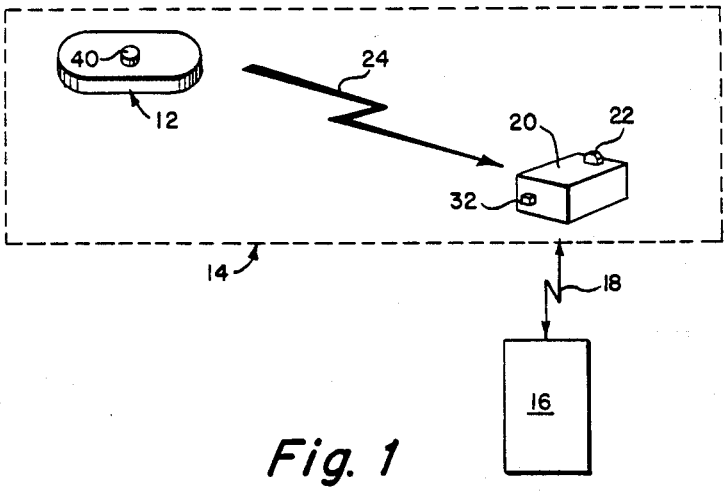
FIG. 1 is a system diagram of a personal emergency response system according to the present invention.

Referring now to the drawings wherein like reference numerals designate corresponding or similar elements throughout the several views, there is shown in FIG. 1 a diagram exemplifying a personal emergency response (PER) system 10 according to the present invention. The PER system 10 includes a portable help button 12, a remote subscriber station 14, a central station 16 and a communications link 18 such as a telephone line interconnecting the remote subscriber station 14 to the central station 16. A subscriber unit 20 having a local annunciator 22 is disposed in the remote subscriber station 14 to interface with the communications link 18.

With the PER system 10 operating in a normal mode, manual operation of the portable help button 12 generates a coded or uncoded activating signal 24 which is transmitted to the subscriber unit 20. The subscriber unit 20 is activated by the signal 24 and processes the activating signal 24 to transmit an alarm signal to the central station 16 via the communications link 18. The alarm message may include remote subscriber station 14 identification data in addition to the alarm data. Concomitantly, the subscriber unit 20 activates the local annunciator 22 to inform the subscriber that the alarm signal has been transmitted.

The portable help button 12 of FIG. 1 is a portable transmitter of the type known in the art and generally includes a housing containing a power source and a transmitter subsystem. A representative example of such a portable transmitter is disclosed in U.S. Pat. No. 4,491,970 owned by the assignee of the present invention. The transmitter subsystem may be of the type generally known in the art such as a radio transmission system, an infrared transmission system or an ultrasonic transmission system. The transmitter subsystem may be configured to transmit either coded or uncoded activating signals 24 depending upon the application.

The portable help button 12 includes a means 40 for activating the portable help button 12 which is designed to be manually operated by the subscriber to transmit a coded or uncoded signal 24 to activate the subscriber unit 20. The activating means 40 may be of a type known in the art. The activating means 40 may be externally located on a face of the housing of the portable help button 12 or may be mounted within the housing and actuated by manually depressing a flexible diaphragm formed as part of the face of the housing.

Figure 2:
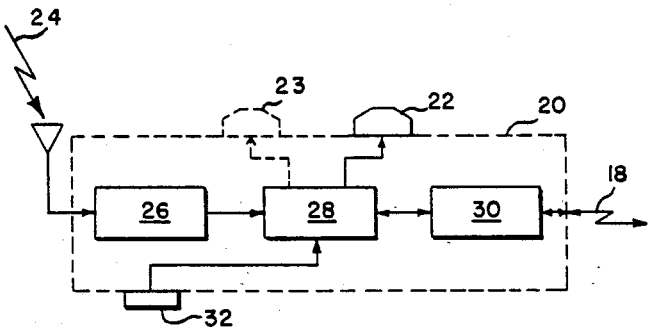
FIG. 2 is a partial block diagram of an embodiment of a subscriber unit according to the present invention.

One embodiment of the subscriber unit 20 according to the present invention is partially depicted in FIG. 2 and includes a receiver unit 26, a control unit 28 such as a microprocessor and transmitter subassembly 30. It is to be understood that the subscriber unit 20 may contain other subsystems typically found in such units, as for example a timing/logic circuit for automatically activating the subscriber unit 20 after a predetermined period of time has elapsed.

The receiver unit 26 is operative to receive the activating signal 24 transmitted by the corresponding portable help button 12. The receiver unit 26 may include a demodulator for PER systems 10 utilizing a coded activating signal 24, as for example where there are a large number of remote subscriber stations 14 within a small area (e.g., apartment complexes).

A valid activating signal 24 activates the control unit 28 which regulates the overall operation of the subscriber unit 20. For example, the control unit 28 activates the transmitter subassembly 28 to transmit the initial alarm message and any follow-on messages to the central station 16. The control unit 28 also activates or deactivates the local annunciator 22 in accordance with a predetermined protocol.

The annunciator 22 generates a signal which indicates to the subscriber that the alarm message has been transmitted to the central station 16. As exemplarily illustrated in FIGS. 1 and 2, the annunciator 22 is a visual signal generating means such as a light emitting diode.

It is to be understood, however, that the annunciator 22 may also be an audible signal generating means, a tactile signal generating means or combinations thereof. It is to be further understood that the signal generated by the annunciator 22 may be a steady signal, an intermittent signal or other type signal. Likewise, it is to be understood that the signal generated by the annunciator 22 may be a limited duration signal, long or short, or an indefinite duration signal which must be reset by the subscriber or the central station.

Conveniently located on a face of the subscriber unit 20 is a momentary action button 32. Operation of the momentary action button 32 places the subscriber unit 20 in the test mode. While the subscriber unit 20 is in the test mode, the control unit 28 will not activate the transmitter subassembly 30 in response to activating signals 24 broadcast by the portable help button 12, and therefore, no alarm messages will be transmitted by the subscriber unit 20 to the central station 16. Inactivation of the transmitter subassembly 30 may be effected by software programming, by mechanically disconnecting the subassembly 30 from the control unit 28 or other suitable means.

In one embodiment, activation of the momentary action button 32 places the subscriber unit 20 in a test mode for a predetermined period of time which is determined by a timing/logic circuit in the control unit 28. Upon expiration of the predetermined period of time, the control unit 28 automatically returns the subscriber unit 20 to the normal mode.

In an alternative embodiment, activation of the momentary action button 32 places the subscriber unit 20 in the test mode semipermanently. To return the subscriber unit 20 to the normal mode of operation, the subscriber must take positive action such as redepressing the momentary action button 32 or returning the momentary action button to the normal mode position.

As an additional feature, the momentary action button 32 may be associated with a light generating means such as an LED which illuminates the momentary action button 32 when the subscriber unit 20 is in the test mode. This provides the subscriber with a positive indication regarding the mode status of the subscriber unit 20. Alternatively, the physical position of the momentary action button 32 may be used to inform the subscriber of the mode status.

For PER systems 10 configured to utilize coded activating signals 24, the subscriber unit 20 may be permanently configured to recognize only activating signals 24 transmitted by the corresponding portable help button 12. In this embodiment, the address code of the subscriber unit 20 is synchronized to recognize only those coded activating signals 24 transmitted by the corresponding portable help button 12, and any other activating signal received by the subscriber unit 20 is treated as an invalid activating signal.

In an alternative embodiment, as described in the related U.S. patent application entitled ADDRESS CODE MODIFICATION IN A TRANSMITTER RECEIVER PAIR, Ser. No. 07/203,251, filed June 6, 1988, the subscriber unit 20 is configured so that the subscriber may change the address code of the subscriber unit 20. The subscriber unit 20 may be temporarily placed in a mode wherein the coded activating signal 24 transmitted by a particular portable help button 12 is set as the address code of the subscriber unit 20. Thereafter, the subscriber unit 20 will be responsive only to the particular address code which corresponds to the coded activating signal 24 of the particular portable help button 12.

While operating in the test mode, valid activating signals 24 which are received by the receiving unit 26 activate the control unit 28 which subsequently activates the local annunciator 22. Activation of the local annunciator 22 provides a positive signal to the subscriber that the portable help button 12 has functioned and/or operated in combination with the subscriber unit 20 in the prescribed manner. Conversely, if the local annunciator 22 does not generate a signal upon operation of the portable help button 12 by the subscriber, the subscriber is informed that the portable help button 12 is not functioning properly, that the portable help button 12 in combination with the subscriber unit 12 is not functioning properly, and/or that the portable help button 12 is located outside its effective transmission range within the remote subscriber station 14 or is located in a transmission dead spot within the remote subscriber station 14.

Figure 3A:
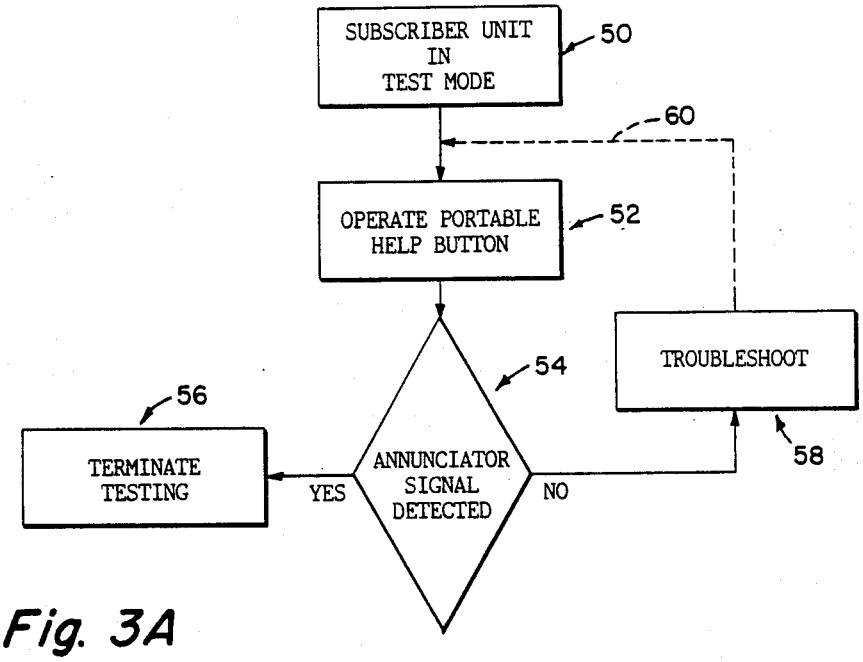
FIG. 3A is an exemplary protocol for periodic testing of the personal emergency response system according to the present invention.
Figure 3B:
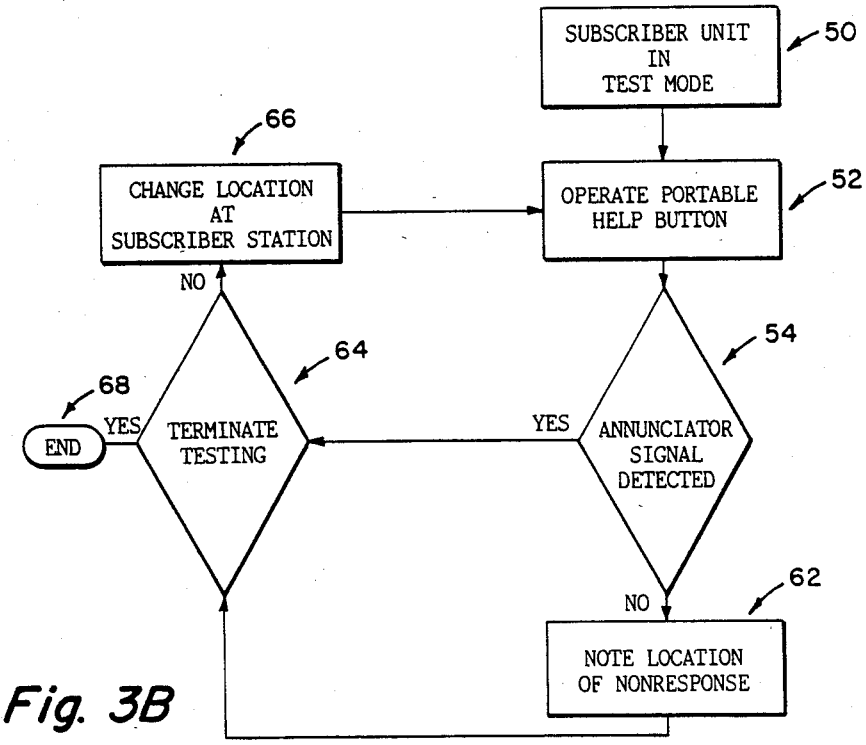
FIG. 3B is an exemplary protocol for operational testing of the personal emergency response system according to the present invention.

Exemplary test protocols for a personal emergency response system (10) according to the present invention are depicted in FIGS. 3A, 3B. The test protocol for periodic testing of the portable help button 12 is shown in FIG. 3A. FIG. 3B illustrates the testing protocol for determining limitations inherent to the operation of the portable help button 12 in combination with the subscriber unit 20 as described hereinabove.

The subscriber unit 20 is placed in the test mode at step 50. While in the test mode, valid activating signals 24 transmitted by operation of the portable help button 12, step 52, will be processed by the subscriber unit 20 and utilized to activate the local annunciator 22. step 54. Preferably, the periodic testing of the portable help button 12 is conducted in close proximity to the subscriber unit 20 to verify that the portable help button 12 is properly functioning in combination with the subscriber unit 20.

After a successful periodic test of the portable help button 12 in combination with the subscriber unit 20, step 54, the subscriber may terminate the test, step 56, or continuing testing, FIG. 3B, to determine operational limitations of the portable help button 12. Testing to determine operational limitations need not be accomplished each time the portable help button 12 is functionally tested.

An indication of nonfunctioning of the portable help button 12 in combination with the subscriber unit 20, i.e., no annunciator signal detected, step 54, may indicate the need for remedial maintenance such as power source replacement or repair/replacement of the portable help button 12, step 58. It may also indicate that the coded activating signal 24 transmitted by the portable help button 12 is not synchronized with the address code of the corresponding subscriber unit 20. Once troubleshooting has been completed, the test sequence can be reinitiated, step 60, to ensure proper functioning of the portable help button 12.

To determine the operational limitations, i.e., range limitations and/or transmission dead spots, of the portable help button 12, the testing protocol of FIG. 3B is employed. The subscriber moves about the remote subscriber station 14, step 66, while concomitantly operating the portable help button 12, step 52. The subscriber identifies locations with the remote subscriber station 14 where no annunciator signal is detected, step 62. The subscriber terminates the test protocol, steps 64, 68, after determining the operational limitations of the portable help button 12 vis-a-vis the remote subscriber station 14.

In another embodiment, the subscriber unit 20 may include a dedicated test annunciator 23 in addition to the local annunciator 22. The dedicated test annunciator 23 would be utilized only in the test mode while the local annunciator 22 would only be operative in the normal mode. Appropriate operating instructions would be provided in the control unit 28.

A variety of modifications and variations of the present invention are possible in light of the above teachings. It is therefore to be understood that within the scope of the appended claims, the present invention may be practiced otherwise than as specifically described hereinabove.

What is claimed is:

1. An apparatus for testing the functioning and operating limitations of a personal emergency response system including a subscriber station capable of transmitting messages over a communications link to a central station, comprising:

portable help button means selectively operable for generating an activating signal at the subscriber station;

subscriber unit means disposed within the subscriber station and normally operative in response to said activating signal for transmitting one or more messages over the communications link to the central station;

annunciator means coupled to said subscriber unit means and operative in response to said activating signal received by said subscriber unit means for generating a perceptible signal indicative of functioning of said subscriber unit means and said portable help button means; and momentary action button means coupled to said subscriber unit means and selectively actuatable for alternately operating said subscriber unit means in a test mode and a normal mode; and wherein operation of said subscriber unit means in said normal mode causes said subscriber unit means to activate said annunciator means to generate said perceptible signal and to transmit one or more messages over the communications link to the central station in response to said activating signal generated by selective operation of said portable help button means; and wherein operation of said subscriber unit means in said test mode causes said subscriber unit means to activate said annunciator means to generate said perceptible signal in response to said activating signal generated by selective operation of said portable help button means, said subscriber unit means being inoperative in said test mode to transmit messages to the central station.

2. The apparatus of claim 1 wherein said portable help button means is selectively operable at different locations at the subscriber station with said subscriber unit means in said test mode to determine operating limitations of said portable help button means and said subscriber unit means coacting in combination at the different locations at the subscriber station.

3. The apparatus of claim 1 wherein said momentary action button means is selectively actuatable to cause said subscriber unit means to operate in said test mode for a predetermined period of time and wherein said subscriber unit means automatically resumes operation in said normal mode upon expiration of said predetermined period of time.

4. The subscriber unit of claim 3 wherein said momentary action button means is a pushbutton.

5. The apparatus of claim 1 wherein said momentary action button means is selectively actuatable to cause said subscriber unit means to operate in said test mode until a predetermined event occurs.

6. The apparatus of claim 5 wherein said predetermined event is a subsequent selective actuation of said momentary action button means to cause said subscriber unit means to operate in said normal mode.

7. The apparatus of claim 1 wherein said momentary action button means is a two-position switch having a first position corresponding to said test mode and a second position corresponding to said normal mode, and wherein said two-position switch remains in said first position until said two-position is subsequently selectively actuated to move said two-position switch to said second position and vice versa.

8. The apparatus of claim 1 further comprising light source means coupled to said momentary action button means for illuminating said momentary action button means to indicate operation of said subscriber unit means in said test mode.

9. A method for testing the functioning and operational limitations of a personal emergency response system, the personal emergency response system including a subscriber station for transmitting messages over a communications link to a central station and wherein the subscriber station includes a portable help button selectively operable to generate an activating signal, a subscriber unit normally operative in response to said activating signal to transmit one or more messages over the communications link to the central station and an annunciator coupled to said subscriber unit for generating a perceptible signal in response to said activating signal, comprising the steps of:

(a) selectively actuating a momentary action button coupled to said subscriber unit to cause said subscriber unit to operate in a test mode, and wherein said subscriber unit is inoperative in said test mode to transmit messages to the central station;

(b) selectively operating said portable help button to generate said activating signal at the subscriber station; and (c) verifying the functioning of said subscriber unit and said portable help button by reception of said perceptible signal generated by said annunciator in response to selective operation of said portable help button.

10. The method of claim 9 further comprising the step of:

(d) allowing a predetermined period of time to expire wherein said subscriber unit automatically resumes operation in a normal mode.

11. The method of claim 9 further comprising the step of:

(d) selectively actuating said momentary action button coupled to said subscriber unit to cause said subscriber unit to operate in a normal mode.

12. The method of claim 9 further comprising the steps of:

(d) moving said portable help button to a different location at the subscriber station;

(e) selectively operating said portable help button at said different location to generate said activating signal at the subscriber station; and (f) verifying the functioning of said subscriber unit and said portable help button at said different location by reception of said perceptible signal generated by said annunciator in response to selective operation of said portable help button; and (g) repeating steps (d)-(f) to determine the operating limitations of said subscriber unit and said portable help button in combination at different locations at the subscriber station.

13. The method of claim 12 further comprising the step of:

(h) allowing a predetermined period of time to expire wherein said subscriber unit automatically resumes operation in a normal mode.

14. The method of claim 12 further comprising the step of:

(h) selectively actuating said momentary action button coupled to said subscriber unit to cause said subscriber unit to operate in a normal mode.

* * * * *

UNITED STATES PATENT AND TRADEMARK OFFICE

CERTIFICATE OF CORRECTION

PATENT NO. : 4,908,602

DATED : March 13, 1990

INVENTOR(S) : Richard M. Reich and Phillip H. Devlin

It is certified that error appears in the above-identified patent and that said Letters Patent is hereby corrected as shown below:

ON THE TITLE PAGE:

In the Title, on the line identified as [54], the Title should read --APPARATUS AND METHOD OF TESTING A PORTABLE HELP BUTTON FOR A PERSONAL EMERGENCY RESPONSE SYSTEM--.

Column 1, lines 1-3, the Title should read --APPARATUS AND METHOD OF TESTING A PORTABLE HELP BUTTON FOR A PERSONAL EMERGENCY RESPONSE SYSTEM--.

Signed and Sealed this

Twenty-eighth Day of July, 1992

*Attest:*

DOUGLAS B. COMER

*Attesting Officer*

*Acting Commissioner of Patents and Trademarks*